US010501820B2

(12) United States Patent
Frobose et al.

(10) Patent No.: US 10,501,820 B2
(45) Date of Patent: Dec. 10, 2019

(54) METHOD FOR PRODUCING A STRAND FROM STAINLESS STEEL AND STRAND MADE OF STAINLESS STEEL

(71) Applicant: SANDVIK MATERIALS TECHNOLOGY DEUTSCHLAND GMBH, Dusseldorf (DE)

(72) Inventors: Thomas Frobose, Versmold (DE); Christofer Hedvall, Dusseldorf (DE); Udo Rauffmann, Dusseldorf (DE)

(73) Assignee: Sandvik Materials Technology Deutschland GmbH, Düsseldorf (DE)

( * ) Notice: Subject to any disclaimer, the term of this patent is extended or adjusted under 35 U.S.C. 154(b) by 180 days.

(21) Appl. No.: 15/551,545

(22) PCT Filed: Feb. 15, 2016

(86) PCT No.: PCT/EP2016/053114

§ 371 (c)(1),
(2) Date: Oct. 10, 2017

(87) PCT Pub. No.: WO2016/131748

PCT Pub. Date: Aug. 25, 2016

(65) Prior Publication Data

US 2018/0223388 A1 Aug. 9, 2018

(30) Foreign Application Priority Data

Feb. 17, 2015 (DE) ..... 10 2015 102 255

(51) Int. Cl.
*C21D 9/52* (2006.01)
*C21D 8/10* (2006.01)
(Continued)

(52) U.S. Cl.
CPC ..... *C21D 9/525* (2013.01); *B21C 23/085* (2013.01); *C21D 6/004* (2013.01); *C21D 6/005* (2013.01);
(Continued)

(58) Field of Classification Search
None
See application file for complete search history.

(56) References Cited

U.S. PATENT DOCUMENTS 3,144,132 A * 8/1964 Bridge ..... B21C 23/085 72/271
3,639,179 A * 2/1972 Reichman ..... C22F 1/10 75/246
(Continued)

FOREIGN PATENT DOCUMENTS

CN 1103437 A 6/1995
CN 102634740 A 8/2012
(Continued)

OTHER PUBLICATIONS

Anonymous: "Seamless instrumentation tube", Stainless steel product guide New Zealand-Sandvik, URL:http://smt.sandvik.com/globalassets/global/downloads/home/sandvik-steel-nz-catalogue-2014-secure.pdf.

*Primary Examiner* — Anthony J Zimmer
*Assistant Examiner* — Ricardo D Morales
(74) *Attorney, Agent, or Firm* — Morgan, Lewis & Bockius LLP

(57) ABSTRACT

A method for manufacturing a strand from a stainless steel by cold forming a billet into the cold-hardened strand and subsequently annealing the strand is provided. The method allows stainless steel strands to be produced, which have both a high tensile strength, as well as a high degree of elongation. The strand is heated to a temperature ranging from 400° C. to 460° C. while the strand is being annealed,
(Continued)

and the cold-hardened strand is surrounded by a protective gas atmosphere during the heating process.

13 Claims, 1 Drawing Sheet

(51) Int. Cl.

| | |
|---|---|
| ***C21D 9/14*** | (2006.01) |
| ***B21C 23/08*** | (2006.01) |
| ***C21D 6/00*** | (2006.01) |
| ***C22C 38/02*** | (2006.01) |
| ***C22C 38/04*** | (2006.01) |
| ***C22C 38/44*** | (2006.01) |

(52) U.S. Cl.
CPC ..... *C21D 6/008* (2013.01); *C21D 8/105* (2013.01); *C21D 9/14* (2013.01); *C22C 38/02* (2013.01); *C22C 38/04* (2013.01); *C22C 38/44* (2013.01); *C21D 2211/001* (2013.01)

(56) References Cited

U.S. PATENT DOCUMENTS

| | | | | |
|---|---|---|---|---|
| 3,655,459 | A | 4/1972 | Brickner et al. | |
| 3,888,119 | A | 6/1975 | Tanczyn | |
| 4,641,513 | A * | 2/1987 | Peytavin | B21B 21/005 72/208 |
| 2004/0261918 | A1 * | 12/2004 | Ando | B21J 1/02 148/649 |
| 2010/0068547 | A1 * | 3/2010 | Schiess | B22F 5/12 428/546 |

FOREIGN PATENT DOCUMENTS

| | | | |
|---|---|---|---|
| CN | 103459639 | A | 12/2013 |
| EP | 1889936 | A1 | 2/2008 |
| EP | 2650059 | A1 | 10/2013 |
| JP | S5276217 | A | 6/1977 |
| JP | H1018018 | A | 1/1998 |
| JP | H157842 | A | 3/1999 |
| JP | 2005298932 | A | 10/2005 |
| WO | 2014034522 | A1 | 3/2014 |

* cited by examiner

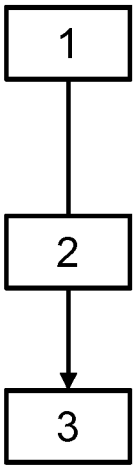
1
2
3

METHOD FOR PRODUCING A STRAND FROM STAINLESS STEEL AND STRAND MADE OF STAINLESS STEEL

RELATED APPLICATION DATA

This application is a § 371 National Stage Application of PCT International Application No. PCT/EP2016/053114 filed Feb. 15, 2016 claiming priority to DE102015102255.9 filed Feb. 17, 2015.

TECHNICAL FIELD

The present disclosure relates to a method for manufacturing a strand of a stainless steel by cold forming of a billet into the strain-hardened strand and subsequently annealing the strand.

The present disclosure also relates to a strand of stainless steel produced by such a method.

BACKGROUND

Stainless steel products in form of a strand, i.e. in particular profiles, rods and tubes, are frequently produced by cold forming a semi-finished product, which is denoted as a billet in this disclosure, to form the actual strand.

In addition to a change in its dimensions, the billet during cold forming also experiences a strain-hardening.

As a result of the cold forming, the stainless steel strand therefore has properties which cannot be achieved by hot forming. In particular, strands with high tensile strength can be produced by cold forming, which cannot be achieved in other ways or are only difficult to achieve. On the other hand, the elongation of cold-formed strands made of stainless steel is rather low compared to strands produced by other forming methods.

SUMMARY

It is therefore an object of the present disclosure to provide a method for manufacturing a strand of a stainless steel which makes it possible to produce strands of stainless steel which have a high tensile strength as well as a high elongation. It is also an object of the present disclosure to provide a strand of stainless steel which has both a high tensile strength and a high elongation.

At least one of the aforementioned objects is solved by a method for manufacturing a strain-hardened strand of a stainless steel by cold-working a billet into the strain-hardened strand and subsequently annealing the strand, wherein the strand is heated to a temperature in a range of 400° C. to 460° C., and wherein the strain-hardened strand is surrounded by a protective gas atmosphere during heating.

Surprisingly, a strain-hardened strand of a stainless steel which is manufactured in this way has a high elongation while at the same time the high tensile strength achieved by the cold forming is maintained or even improved.

This is surprising in that annealing of a strand of a stainless steel in the prior art is always referred to as so-called soft annealing or recrystallization annealing, i.e. in order to reduce the tensile strength, usually in favor of a workability of the strand in a further cold forming step.

For the purposes of the present disclosure, when temperatures of the strand during annealing are described, this specification refers to the surface temperature of the strain-hardened strand itself. For the purposes of the present disclosure, cold forming processes are all forming processes in which the billet, i.e. the semi-finished product, at temperatures below the recrystallization temperature of the stainless steel used.

For the purposes of the present disclosure, the cold forming is carried out, in particular, by cold pilger milling or cold-drawing.

In particular, for the production of precise tubes made of stainless steel, an expanded billet, raw billet as a semi-finished product is cold-reduced by compressive stresses in the fully cooled state.

The billet is then formed into a tube with a defined, reduced outer diameter and a defined wall thickness.

For this purpose, in the case of cold pilger milling (also referred to as cold pilgering), the billet is fed over a calibrated mandrel, i.e. a mandrel comprising the inner diameter of the finished tube, and simultaneously, from the outside, the billet is gripped by two calibrated rollers, i.e. rollers defining the outer diameter of the finished tube, and the billet is milled over the mandrel in a longitudinal direction.

During cold pilger milling, the billet undergoes a step-by-step feed in the direction of the mandrel or over it. Between two feed steps, the rollers are rotated over the mandrel and thus the billet, and they mill the billet. At each turning point of the roll stand with the rollers attached thereto, the rollers release the billet and the billet is fed by a further step in the direction of the tool, i.e. towards the mandrel or the rollers.

Feeding of the billet over the mandrel is effected by means of a translatorily driven feed carriage, which carries out a translation motion in a direction parallel to the axis of the mandrel and transfers this motion to the billet.

During feeding, the billet is also rotated about its longitudinal axis in order to allow uniform milling of the billet. By repeatedly milling each tube section, a uniform wall thickness and roundness of the tube as well as uniform inside and outside diameters are achieved. Therefore, typically the feed steps are smaller than the total stroke of the roll stand between the two reversal points.

On the other hand, during cold drawing as a further cold forming process to be considered as an example here, a strand-shaped billet is pulled through a drawing die which has an inner diameter which is less than the outer diameter of the billet and which is thus deformed and re-dimensioned.

Depending on the tool used, for drawing of tubes a so-called billet drawing, in which the forming is merely effected by means of a previously described drawing die (also referred to as a pulling ring, drawing billet or drawing block) is distinguished from a so called core drawing or rod drawing, wherein the inner diameter as well as the wall thickness of the drawn tube are defined by a mandrel arranged inside the billet.

For the purposes of the present disclosure, the tensile strength is understood to be the tension which is calculated in the tensile test from the maximum tensile force reached immediately before fracture of the specimen with reference to the original cross-section of the specimen. The dimension of the tensile strength is force per area.

Elongation in the sense of the present disclosure is understood to mean the permanent extension of a strand, which is drawn under the effect of a force until failure, relative to the length measured initially. This elongation is also referred to as ultimate stress or elastic limit. The ultimate stress is calculated as the quotient of the remaining length change after failure divided by the initial length before applying the force. This results in a dimensionless quantity, which is often given as a percentage value.

It is surprising that, within the stated temperature range of 400° C. to 460° C. the strain hardening of the strand by cold forming, i.e. the high tensile strength obtained, is further increased by the annealing, while at the same time the elongation is not significantly reduced.

A macroscopic or microscopic change of strands which have been annealed by the Applicant after the cold forming in this temperature range cannot was not observed.

A particularly advantageous improvement in the tensile strength while maintaining a high elongation when compared to a cold forming process which completely dispenses with annealing after cold forming is in a range of 410° C. to 450° C., preferably in a range of 435° C. to 445° C. and particularly preferably at 440° C.

In order to minimize oxidation of the stainless steel material during annealing, the annealing is carried out in a protective gas atmosphere surrounding the strand during annealing. This protective gas atmosphere advantageously in one embodiment comprises argon, preferably a fraction of argon of more than 95% by volume.

In one embodiment of the disclosure, the oxygen content of the protective gas atmosphere during annealing is less than 50 ppm, preferably less than 15 ppm, and more preferably less than 10 ppm. Then oxidation processes at the surface of the strand are negligible.

In one embodiment of the disclosure, the dew point of the protective gas atmosphere is at atmospheric pressure (1013 mbar) at a temperature of −40° C. or less, preferably −50° C. or less.

While it is assumed that the described effect of the annealing at the temperatures according to the present disclosure occurs in all stainless steel materials, it could be explicitly demonstrated by the inventors, in particular, for austenitic stainless steels.

For the purposes of the present disclosure, an austenitic stainless steel is understood to be a cubic-surface-centered mixed crystal of an iron alloy, in particular a y-mixed crystal.

In particular, the effect in the case occurs in a stainless steel containing not more than 0.06% by weight of carbon, manganese in a fraction of not more than 2% by weight, silicon in a fraction of not more than 0.7% by weight, chromium in a fraction of 16% by weight to 20% by weight, and molybdenum in a fraction of 2.0% by weight to 2.6% by weight, with a balance of iron and unavoidable Impurities.

A strand in the sense of the present disclosure is a workpiece with a larger, in particular much larger, longitudinal extent compared to its cross-section. Examples of strands are profiles, rods, in particular round rods, as well as tubes.

While the method according to the disclosure can be used for all types of strands, it is particularly advantageous for the production of tubes. Tubes with a high tensile strength and at the same time with a high elongation are mainly needed in the field of medical implants but also as high-pressure lines for a wide range of applications.

While it would initially be assumed that the described effect of the annealing occurs at the temperatures according to the disclosure only in the case of thin-walled strain-hardened stainless steel tubes, it has surprisingly been found that the effect also occurs in the case of rod-shaped strain hardened strands with a solid cross-section and in particular also in thick-walled tubes. Such thick-walled tubes are required in the high-pressure technique for fluid guidance. In a tubular strand, the billet and the finished strand have an inner diameter and an outer diameter. Tubes in which the inner diameter is half the outer diameter or less, preferably one third of the outer diameter or less, are considered to be high-pressure resistant and are referred to as high-pressure tubes for the purposes of the present disclosure.

At least one of the above-mentioned objects is also achieved by a strand of stainless steel, which is produced by an embodiment of the method described above. In one embodiment of the disclosure, the strain-hardened strand is a tube with an inner diameter and an outer diameter, the inner diameter being half of the outer diameter or less, preferably one third of the outer diameter or less.

Further advantages, features and possible applications of the present disclosure will become apparent from the following description of an example.

Embodiments of the present invention will be explained in detail with reference to the drawings.

BRIEF DESCRIPTION OF THE DRAWINGS

FIG. 1 shows a flow chart of a method for manufacturing a stainless steel tube according to an embodiment of the present disclosure.

DETAILED DESCRIPTION

In a test, a tube was formed from an austenitic stainless steel according to DIN1.44/41 containing carbon in a fraction of not more than 0.06% by weight, manganese in a fraction of not more than 1.8% by weight, silicon in a fraction of not more than 0.7% by weight, nickel in a fraction of 1% by weight, chromium in a fraction of 17% by weight and molybdenum in a fraction of 2.3% by weight with a balance of iron and unavoidable impurities.

The billet was first cold-reduced by means of cold pilger milling into a ready-made stainless steel tube.

The tube milled like this has an elongation A(H) of 25.0% and a tensile strength Rp 0.2 of 762 N/mm$^2$.

Subsequently, this cold-drawn tube was annealed under a protective gas atmosphere with a fraction of argon of more than 95% by volume at a temperature of 440° C. The oxygen content in the protective gas atmosphere was less than 10 ppm.

The annealed tube has an elongation A(H) of 15.1% after annealing. The tensile strength Rp 0.2 is 812 N/mm$^2$.

For purposes of explanation, the method for manufacturing a stainless steel tube according to the present disclosure is briefly summarized again with reference to the flow chart of FIG. 1.

First, in step 1, a tube of austenitic stainless steel is provided as the starting material as a billet. In addition to iron and unavoidable impurities, the stainless steel contains carbon in a fraction of not more than 0.06% by weight, manganese in a fraction of not more than 1.8% by weight, silicon in a fraction of not more than 0, 7% by weight, nickel in a fraction of 11% by weight, chromium in a fraction of 17% by weight and molybdenum in a fraction of 2.3% by weight. This billet is then cold-formed by cold pilger milling in step 2 into the completely dimensioned tube.

The finished tube is then annealed in step 3 under a protective gas atmosphere with an argon content of more than 95% by volume and an oxygen content in the protective gas atmosphere of less than 10 ppm at a temperature of 440° C.

For the purposes of the original disclosure, it is to be understood that all features as will become apparent to those skilled in the art from the present description, drawings and claims, although described specifically only in combination with certain further features, can be combined both individually and in arbitrary combinations with other features or groups of features disclosed herein, as far as such combination has not been expressly excluded or technical circumstances make such combinations impossible or meaningless. A comprehensive, explicit description of all conceivable combinations of features is omitted here only for the sake of brevity and the legibility of the description.

While the disclosure has been illustrated and described in the drawings and the foregoing description, this description is given by way of example only and is not intended to form a limitation of the scope of the disclosure as defined by the claims. The disclosure is not restricted to the examples disclosed.

Modifications of the disclosed examples will be apparent to those skilled in the art from the drawings, the specification, and the appended claims. In the claims, the word "comprise" does not exclude other elements or steps and the undefined article "a" or "an" does not exclude a plurality. The mere fact that certain features are claimed in different claims does not exclude their combination. Reference signs in the claims are not intended to be limiting the scope of protection.

The invention claimed is:

1. A method for manufacturing a strand of stainless steel comprising:

cold forming a billet into a strain-hardened strand; and subsequently annealing the strand, wherein during annealing of the strand the strand is heated to a temperature in a range from 400° C. to 460° C., and wherein the strain-hardened strand is surrounded by a protective gas atmosphere during heating, and wherein the material of the billet is an austenitic stainless steel having a composition consisting of not more than 0.06 weight % carbon, not more than 2 weight % manganese, not more than 0.7 weight % silicon, 16 to 20 weight % chromium, 2.0 to 2.6 weight % molybdenum, with a balance of iron and unavoidable impurities.

2. The method according to claim 1, wherein the strand is heated to a temperature in the range from 410° C. to 450° C.

3. The method according to claim 1, further comprising the step of cooling the strand after heating, wherein the strand during cooling is surrounded by the protective gas atmosphere.

4. The method according to claim 1, wherein the protective gas atmosphere includes argon, having a fraction of argon of more than 95% by volume.

5. The method according to claim 1, wherein the protective gas atmosphere has an oxygen content of less than 50 ppm.

6. The method according to claim 1, wherein a dew point of the protective gas atmosphere at atmospheric pressure is at a temperature of −40° C. or less.

7. The method according to claim 1, wherein the strand is a tube.

8. The method according to claim 1, wherein the billet and the strand are in the form of a tube with an inner diameter and an outer diameter, and wherein by the cold forming a tube is formed, the inner diameter of which is half of the outer diameter or less.

9. The method according to claim 1, wherein the cold forming is carried out by cold pilger milling.

10. A strand of stainless steel made according to the method of claim 1.

11. The strand of stainless steel according to claim 10, wherein the strand is a tube with an inner diameter and an outer diameter, the inner diameter being one half of the outer diameter or less.

12. The method according to claim 1, wherein the strand is heated to a temperature in the range from 435° C. to 445° C.

13. The method according to claim 1, wherein the strand is heated to a temperature of 440° C.

* * * * *